US011273954B2

(12) United States Patent
Asami et al.

(10) Patent No.: US 11,273,954 B2
(45) Date of Patent: Mar. 15, 2022

(54) PALLET, PALLET STACKING SYSTEM AND PALLET STACKING METHOD

(71) Applicant: TOYOTA JIDOSHA KABUSHIKI KAISHA, Toyota (JP)

(72) Inventors: Daisuke Asami, Toyota (JP); Tomoaki Ihara, Toyota (JP); Takumi Shigemasa, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 17/194,984

(22) Filed: Mar. 8, 2021

(65) Prior Publication Data

US 2021/0380310 A1 Dec. 9, 2021

(30) Foreign Application Priority Data

Jun. 3, 2020 (JP) ..... JP2020-096753

(51) Int. Cl.
*B65D 19/00* (2006.01)
*B65D 19/38* (2006.01)

(52) U.S. Cl.
CPC .... *B65D 19/385* (2013.01); *B65D 2519/0097* (2013.01); *B65D 2519/00542* (2013.01)

(58) Field of Classification Search
CPC ..... B65D 19/385; B65D 2519/00542; B65D 2519/0097
See application file for complete search history.

(56) References Cited

U.S. PATENT DOCUMENTS

| | | | | |
|---|---|---|---|---|
| 5,692,625 | A * | 12/1997 | Filipescu | A47B 43/00 211/194 |
| 6,279,763 | B1 * | 8/2001 | Bush | A47B 43/00 108/55.1 |
| 6,325,224 | B1 * | 12/2001 | Brown | B65D 19/385 108/53.1 |
| 9,452,865 | B2 * | 9/2016 | Joshi | B65D 19/06 |
| 2009/0272705 | A1 * | 11/2009 | Francis | B65D 19/08 211/126.12 |
| 2015/0257530 | A1 * | 9/2015 | Naka | A47B 47/0091 211/188 |
| 2017/0158428 | A1 * | 6/2017 | Reynolds | A47B 57/26 |
| 2018/0118408 | A1 * | 5/2018 | Bradley | B65D 88/129 |
| 2019/0136505 | A1 * | 5/2019 | Bedel | F16B 12/48 |
| 2021/0016927 | A1 * | 1/2021 | Boutwell | B65D 81/05 |

FOREIGN PATENT DOCUMENTS

| | | | |
|---|---|---|---|
| JP | 2004-142795 | A | 5/2004 |
| JP | 2012-254807 | A | 12/2012 |
| JP | 2018-058679 | A | 4/2018 |

* cited by examiner

*Primary Examiner* — Matthew W Ing
(74) *Attorney, Agent, or Firm* — Sughrue Mion, PLLC

(57) ABSTRACT

A pallet that is stackable in an up-down direction in which upper end portions of a plurality of columns of a pallet disposed in a lower stage are inserted into inserted portions provided in lower end portions of columns of a pallet disposed in an upper stage. A height of at least one column is higher than heights of other columns.

10 Claims, 7 Drawing Sheets

PALLET, PALLET STACKING SYSTEM AND PALLET STACKING METHOD

CROSS-REFERENCE TO RELATED APPLICATION

This application claims priority to Japanese Patent Application No. 2020-096753 filed on Jun. 3, 2020, incorporated herein by reference in its entirety.

BACKGROUND

1. Technical Field

The present disclosure relates to a pallet, a pallet stacking system, and a stacking method, and for example, specifically relates to a pallet that can be stacked in the up-down direction in which the upper end portions of a plurality of columns of the pallet disposed in the lower stage are inserted into the inserted portions provided in the lower end portions of the pallet disposed in the upper stage, a pallet stacking system, and a stacking method.

2. Description of Related Art

Generally, a pallet has a configuration in which the upper end portions of a plurality of columns of the pallet disposed in the lower stage are inserted into the inserted portions provided in the lower end portions of the pallet disposed in the upper stage, such that the pallet can be stacked in the up-down direction. At this time, the pallet cannot be stacked unless the upper end portions of the columns of the pallet disposed in the lower stage and the inserted portions of the pallet disposed in the upper stage are disposed with high accuracy.

In view of this, Japanese Unexamined Patent Application Publication No. 2018-58679 (JP 2018-58679 A) discloses a technique that detects the inclination and the center position of the pallet disposed in the lower stage using a plurality of two-dimensional distance meters provided in the forklift to adjust the stacking position of the pallet disposed in the upper stage based on the detection results.

SUMMARY

The applicant has found the following issues. The technique described in JP 2018-58679 A requires the use of a plurality of two-dimensional distance meters for adjusting the stacking position of the pallet disposed in the upper stage, and thus the cost increases in order to stack the pallet accurately.

In view of such an issue, the present disclosure realizes a pallet, a pallet stacking system, and a pallet stacking method that can accurately stack the pallet while suppressing an increase in cost.

A pallet according to an aspect of the present disclosure is a pallet that is stackable in an up-down direction in which upper end portions of a plurality of columns of a pallet disposed in a lower stage are inserted into inserted portions provided in lower end portions of columns of a pallet disposed in an upper stage. A height of at least one of the columns is higher than heights of the other columns. As described above, the pallet has a simple configuration in which, the height of at least one of the columns is higher than the heights of the other columns. Therefore, when the pallet is used, the pallet can be stacked with high accuracy while suppressing an increase in cost.

The above palette may include a guide portion in a lower portion of each of the inserted portions. When the pallet disposed in the upper stage is stacked on the pallet disposed in the lower stage, the guide portion of the inserted portion of the pallet disposed in the upper stage may guide a body portion provided above the guide portion of the inserted portion of the pallet disposed in the upper stage to the upper end portion of the column of the pallet disposed in the lower stage. With such a configuration, the body portion of the inserted portion of the pallet disposed in the upper stage can be easily guided substantially directly above the column of the pallet disposed in the lower stage.

In the above palette, a depth of the inserted portion of the column having a height higher than the heights of the other columns may be deeper than depths of the inserted portions of the other columns.

In the above palette, a difference between the depth of the inserted portion of the column having a height higher than the heights of the other columns and the depths of the inserted portions of the other columns may be equal to a difference between the height of the column having a height higher than the heights of the other columns and the heights of the other columns. As a result, the pallet disposed in the upper stage can be stacked on the upper side of the pallet disposed in the lower stage while suppressing the inclination of the pallet disposed in the upper stage with respect to the pallet disposed in the lower stage.

In the above palette, the column may have a polygonal shape or a shape having a rotation stopper. An inner peripheral shape of at least a part of the inserted portion may be larger than an outer peripheral shape of the column, and may have a polygonal shape corresponding to the outer peripheral shape of the column or a shape having a rotation stopper. Here, it is desirable that the polygonal shape has two orthogonal sides. As a result, when the upper end portion of the column of the pallet disposed in the lower stage is inserted into the inserted portion of the pallet disposed in the upper stage, for example, two sides of the inserted portion of the pallet disposed in the upper stage contact two sides of the upper end portion of the column of the pallet disposed in the lower stage, and thus the rotation angle and the position of the pallet disposed in the upper stage with respect to the pallet disposed in the lower stage can be accurately defined.

A pallet according to another aspect of the present disclosure is a pallet that is stackable in an up-down direction in which upper end portions of a plurality of columns of a pallet disposed in a lower stage are inserted into inserted portions provided in lower end portions of columns of a pallet disposed in an upper stage. The pallet includes a cup that is provided in at least one of the columns so as to be slidable in a height direction of the column. The cup protrudes from a lower end portion of the inserted portion when the pallet is raised. As described above, the pallet has a simple configuration in which, of the columns, at least one of the columns is provided with the slidable cup. Therefore, when the pallet is used, the pallet can be stacked with high accuracy while suppressing an increase in cost.

The above palette may include a guide portion in a lower portion of each of the inserted portions. When the pallet disposed in the upper stage is stacked on the pallet disposed in the lower stage, the guide portion of the inserted portion of the pallet disposed in the upper stage may guide a body portion provided above the guide portion of the inserted portion of the pallet disposed in the upper stage to the upper end portion of the column of the pallet disposed in the lower stage. The cup may cover the lower end portion of the guide portion when the pallet disposed in the upper stage is raised.

With such a configuration, the body portion of the inserted portion of the pallet disposed in the upper stage can be easily guided substantially directly above the column of the pallet disposed in the lower stage.

A pallet stacking system according to another aspect of the present disclosure includes: the above palette; a self-propelled moving body that raises and lowers the pallet; and a detection unit provided in the moving body to detect a preset column in the pallet. Since the above pallet having a simple configuration is used, the pallet can be stacked with high accuracy while suppressing an increase in cost.

A pallet stacking method according to another aspect of the present disclosure is a method for stacking a pallet in which upper end portions of a plurality of columns of a pallet disposed in a lower stage are inserted into inserted portions provided in lower end portions of columns of a pallet disposed in an upper stage. The pallet stacking method includes: disposing the pallet disposed in the upper stage on an upper side of the pallet disposed in the lower stage in which a height of at least one of the columns is higher than heights of the other columns; lowering the pallet disposed in the upper stage and inserting an upper end portion of the column having a height higher than the heights of the other columns of the pallet disposed in the lower stage into an inserted portion of the pallet disposed in the upper stage; and further lowering the pallet disposed in the upper stage and inserting upper end portions of the other columns of the pallet disposed in the lower stage into the inserted portions of the pallet disposed in the upper stage. As described above, since the pallet having a simple configuration in which the height of at least one of the columns is higher than the heights of the other columns is used, the pallet can be stacked with high accuracy while suppressing an increase in cost.

A pallet stacking method according to another aspect of the present disclosure is a method for stacking a pallet in which upper end portions of a plurality of columns of a pallet disposed in a lower stage are inserted into inserted portions provided in lower end portions of columns of a pallet disposed in an upper stage. The pallet stacking method includes: raising the pallet disposed in the upper stage and having a cup that is provided in at least one of the columns so as to be slidable in a height direction of the column to protrude the cup from a lower end portion of the inserted portion; lowering the pallet disposed in the upper stage and inserting the upper end portion of the column of the pallet disposed in the lower stage into the cup of the pallet disposed in the upper stage; rotating the pallet disposed in the upper stage around the upper end portion of the column of the pallet disposed in the lower stage, the upper end portion being inserted into the cup of the pallet disposed in the upper stage, to align the upper end portion of the column of the pallet disposed in the lower stage with the inserted portion of the pallet disposed in the upper stage; and further lowering the pallet disposed in the upper stage and inserting the upper end portion of the column of the pallet disposed in the lower stage into the inserted portion of the pallet disposed in the upper stage. As described above, since the pallet having a simple configuration in which a cup is slidably provided in at least one of the columns is used, the pallet can be stacked with high accuracy while suppressing an increase in cost.

According to the present disclosure, it is possible to realize a pallet, a pallet stacking system and a pallet stacking method that can accurately stack a pallet while suppressing an increase in cost.

BRIEF DESCRIPTION OF THE DRAWINGS

Features, advantages, and technical and industrial significance of exemplary embodiments of the disclosure will be described below with reference to the accompanying drawings, in which like signs denote like elements, and wherein.

DETAILED DESCRIPTION OF EMBODIMENTS

Hereinafter, specific embodiments to which the present disclosure is applied will be described in detail with reference to the drawings. However, the present disclosure is not limited to the following embodiments. The following description and drawings are simplified as appropriate for the sake of clarity.

First Embodiment

First, the configuration of the pallet according to the present embodiment will be described. The following description is made based on a state where the pallet is placed on a horizontal surface. Further, the following description is made based on the up-down direction, the front-rear direction, and the right-left direction shown in FIG. 1, but the front-rear direction and the right-left direction may be appropriately replaced with each other depending on the arrangement of the pallets.

Figure 1:
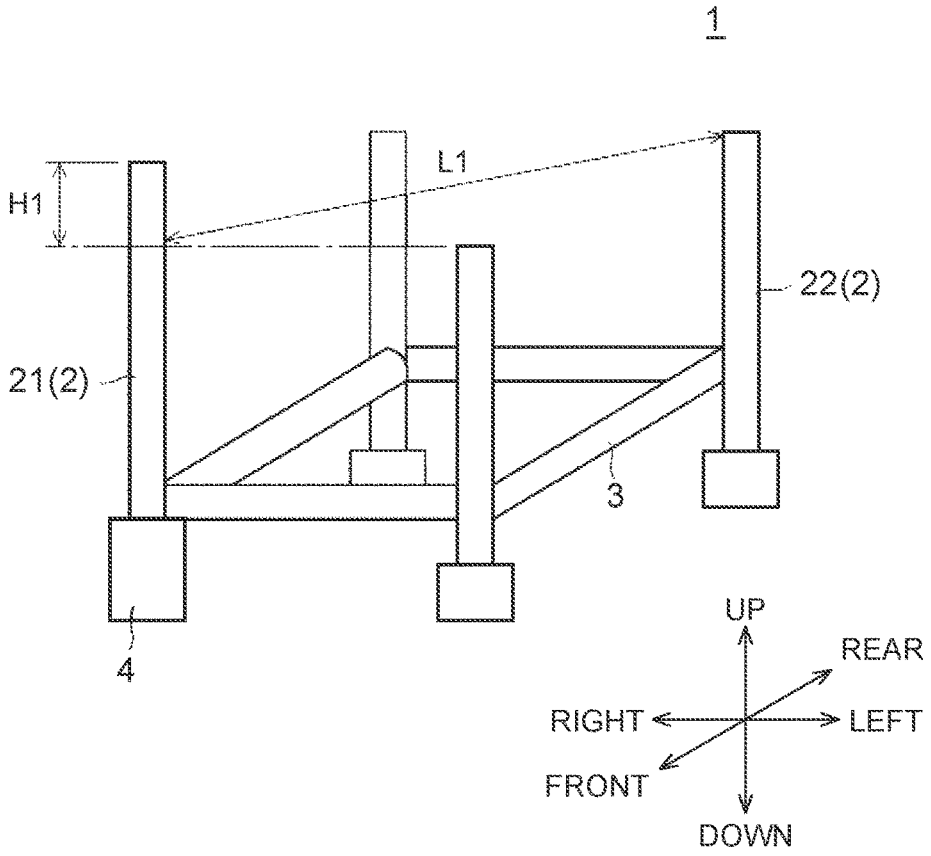
FIG. 1 is a perspective view showing a pallet according to a first embodiment.
Figure 2:
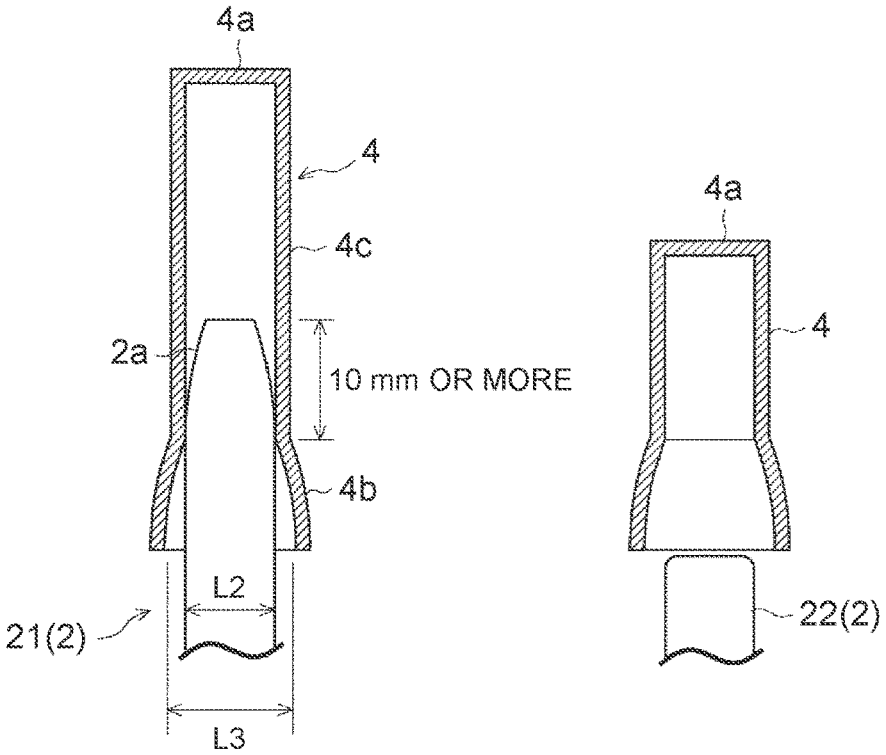
FIG. 2 is a diagram showing the relationship between the height of an upper end portion of a column of a pallet disposed in the lower stage and the depth of an inserted portion of a pallet disposed in the upper stage.

FIG. 1 is a perspective view showing a pallet according to the present embodiment. FIG. 2 is a diagram showing the relationship between the height of the upper end portion of the column of the pallet disposed in the lower stage and the depth of the inserted portion provided in the lower end portion of the column of the pallet disposed in the upper stage.

A pallet 1 of the present embodiment is suitable for stacking and arranging work pieces in a facility such as a warehouse, for example. The pallet 1 has a configuration in which the upper end portions of the columns 2 of the pallet disposed in the lower stage (hereinafter may be referred to as a second pallet 12) are inserted into inserted portions 4 provided in the lower end portions of the columns 2 of the pallet disposed in the upper stage (hereinafter may be referred to as a first pallet 11), such that the pallet 1 can be stacked in the up-down direction (see FIG. 3C).

Specifically, as shown in FIG. 1, the pallet 1 includes the columns 2, beams 3, and the inserted portions 4, and for example, the pallet 1 is assembled into a rectangular frame structure when viewed in the up-down direction. However, the shape of the pallet 1 when viewed in the up-down direction is not limited to the rectangular shape, and may be a circular shape, an elliptical shape, or a polygonal shape.

The columns 2 extend in the up-down direction and are disposed at the corners of the pallet 1 when viewed in the up-down direction. Of the columns 2, the height of at least one column 2 (hereinafter may be referred to as a first column 21) is higher than that of the other columns 2 (hereinafter may be referred to as second columns 22). Therefore, the first column 21 projects further upward with respect to the second columns 22 by a height H1.

The height H1 is preferably set in the range of 1% to 20% of the diagonal length L1 of the pallet 1. Specifically, for example, when the diagonal length L1 of the pallet 1 is 1000 mm, the height H1 is preferably set in the range of 10 mm to 200 mm. The reason for setting the height H1 in the above range will be described later.

The first column 21 is preferably a rectangular column with two adjacent sides substantially orthogonal to each other. It is preferable that a pair of opposite sides of the first column 21 extends substantially in the right-left direction, and the other pair of opposite sides of the first column 21 extends substantially in the front-rear direction. Further, as shown in FIG. 2, the upper end portion of the first column 21 is preferably provided with a tapered portion 2*a* that narrows toward the upper side of the first column 21.

However, although detailed functions will be described later, the outer peripheral shape of the upper end portion of the first column 21 is preferably a polygonal shape or a shape having a rotation stopper. The outer peripheral shapes of the second columns 22 are not limited, but if they are the same as the outer peripheral shape of the first column 21, the pallet 1 can be manufactured using the same member as the first column 21. The columns 2 preferably have a hollow structure for weight reduction. Here, the "rotation stopper" means a portion provided to restrict the rotation of the first pallet 11 when the upper end portion of the first column 21 of the second pallet 12 is inserted into the inserted portion 4 of the first column 21 of the first pallet 11, as will be described later.

The beams 3 connect the lower portions of the adjacent columns 2. In this case, to be able to insert forks 5*a* of a forklift 5 between the beam 3 and the facility floor (see FIG. 3A), the height between the lower end portions of the beams 3 and the lower end portions of the pallet 1 is set higher than the height of the forks 5*a* of the forklift 5.

The inserted portion 4 is provided at the lower end portion of each of the columns 2, and when the first pallet 11 is stacked on the upper side of the second pallet 12, the upper end portions of the columns 2 of the second pallet 12 are inserted into the inserted portions 4 of the first pallet 11. As shown in FIG. 2, the inserted portion 4 has a tubular shape having a bottom portion 4*a* at the upper end portion of the inserted portion 4, and the inner peripheral shape of the inserted portion 4 corresponds to the outer peripheral shape of the upper end portion of the column 2.

For example, the inner peripheral shape of at least a part of the inserted portion 4 provided in the first column 21 is preferably a rectangular shape that is slightly larger than the outer peripheral shape of the upper end portion of the first column 21. The inner peripheral shapes of the inserted portions 4 provided in the second columns 22 are preferably slightly larger than the outer peripheral shapes of the upper end portions of the second columns 22.

The depth of the inserted portion 4 provided in the first column 21 is deeper than the depths of the inserted portions 4 provided in the lower end portions of the second columns 22 by the height H1. That is, the depth of the inserted portion 4 of the first column 21 is deeper than the depth of the inserted portions 4 of the second columns 22 by the height H1 by which the first column 21 projects further upward with respect to the second columns 22.

As shown in FIG. 2, it is preferable that a guide portion 4*b* is provided in the lower portion of the inserted portion 4. The guide portion 4*b* guides a body portion 4*c* provided above the guide portion 4*b* in the inserted portion 4 of the first pallet 11 to the upper end portion of the column 2 of the second pallet 12.

The inner peripheral shape of the guide portion 4*b* is an inverted bowl-shape that narrows toward the upper side of the guide portion 4*b*, and the upper end portion of the inner peripheral surface of the guide portion 4*b* is substantially continuous with the lower end portion of the inner peripheral surface of the body portion 4*c*. That is, the inserted portion 4 of the present embodiment includes the guide portion 4*b* having an inverted bowl-shaped inner peripheral surface, and the body portion 4*c* provided above the guide portion 4*b* and having a rectangular inner peripheral surface.

Here, as shown in FIG. 2, the relationship between the length L2 of one side of the column 2 and the length L3 of one side of the lower opening of the guide portion 4*b* (for example, the short axial length of the inner peripheral edge of the lower end in the lower opening of the guide portion 4*b*) preferably satisfies <Equation 1>.

$$1.2\times L2<L3<5\times L2 \quad \text{<Equation 1>}$$

Further, it is preferable to set the height H1 and the height of the guide portion 4*b* to heights where, when the upper end portion of the first column 21 of the second pallet 12 is inserted into the body portion 4*c* of the inserted portion 4 provided on the first column 21 of the first pallet 11 by about 10 mm or more, the upper end portions of the second columns 22 of the second pallet 12 are inserted into the guide portions 4*b* of the inserted portions 4 provided in the second columns 22 of the first pallet 11.

Figure 3A:
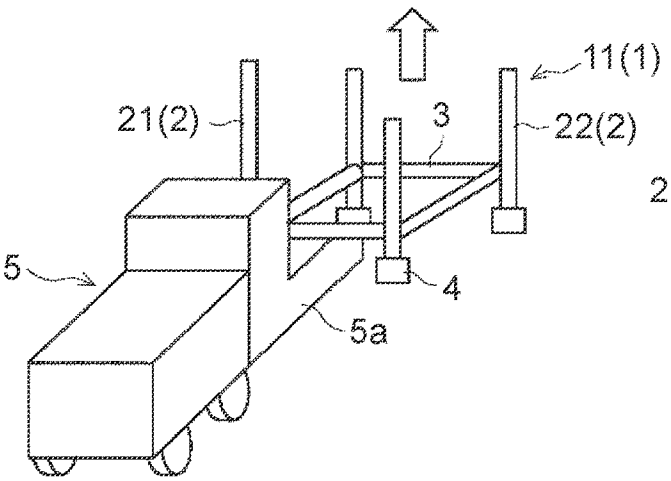
FIG. 3A is a diagram showing how the pallet according to the first embodiment is stacked.
Figure 3B:
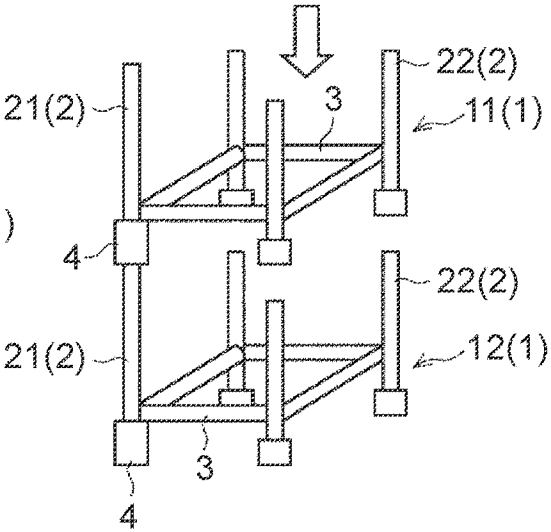
FIG. 3B is a diagram showing how the pallet according to the first embodiment is stacked.
Figure 3C:
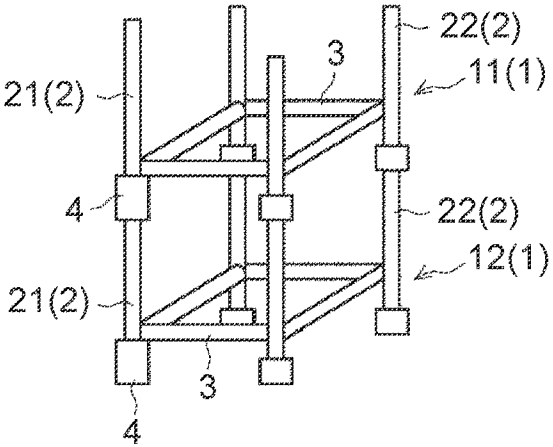
FIG. 3C is a diagram showing how the pallet according to the first embodiment is stacked.

Next, the flow of stacking the pallet 1 will be described using the pallet 1 of the present embodiment. Here, in the present embodiment, it is assumed that an operator operates the forklift 5 to stack the pallet 1. FIGS. 3A to 3C are diagrams showing how the pallet according to the present embodiment is stacked. In FIG. 3B and FIG. 3C, the forklift is omitted for clarity of the movement of the pallet.

First, as shown in FIG. 3A, the forks 5*a* of the forklift 5 are inserted between the beam 3 of the first pallet 11 placed on the facility floor and the floor, and the first pallet 11 is raised by the forklift 5. At this time, the first pallet 11 is raised in the state where the position of the first column 21 of the first pallet 11 is aligned with the position of the first column 21 of the second pallet 12 placed on the facility floor in advance (right front side in FIG. 3B).

Then, the forklift 5 places the first pallet 11 on the upper side of the second pallet 12. At this time, the first pallet 11 is placed on the second pallet 12 so that the first column 21 of the second pallet 12 is disposed substantially directly below the first column 21 of the first pallet 11, and the second columns 22 of the second pallet 12 are disposed substantially directly below the second columns 22 of the first pallet 11.

Next, as shown in FIG. 3B, the forklift 5 lowers the first pallet 11 and inserts the upper end portion of the first column 21 of the second pallet 12 into the inserted portion 4 provided in the first column 21 of the first pallet 11.

Figure 4A:
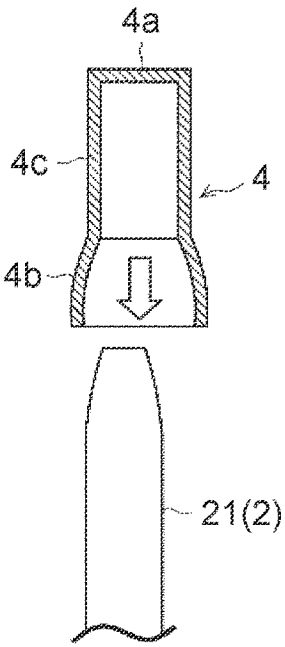
FIG. 4A is a diagram showing how the upper end portion of the column of the pallet disposed in the lower stage is inserted into the inserted portion of the pallet disposed in the upper stage.

FIGS. 4A to 4D are diagrams showing how the upper end portion of the first column of the second pallet is inserted into the inserted portion provided in the first column of the first pallet. Specifically, as shown in FIG. 4A, the first pallet 11 is lowered so that the upper end portion of the first column 21 of the second pallet 12 is inserted into the guide portion 4*b* of the inserted portion 4 provided in the first column 21 of the first pallet 11.

Figure 4B:
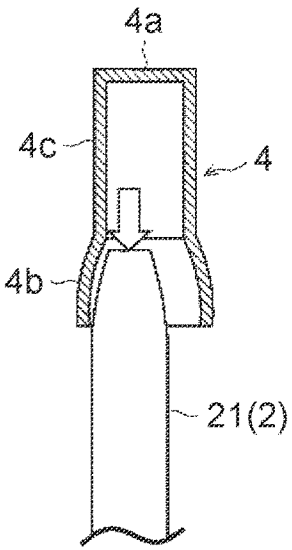
FIG. 4B is a diagram showing how the upper end portion of the column of the pallet disposed in the lower stage is inserted into the inserted portion of the pallet disposed in the upper stage.

Then, as shown in FIG. 4B, the upper end portion of the first column 21 of the second pallet 12 is inserted into the guide portion 4*b* of the inserted portion 4 provided in the first column 21 of the first pallet 11. At this time, the guide portion 4*b* of the first pallet 11 has an inverted bowl-shape.

Therefore, the position of the first pallet 11 with respect to the second pallet 12 is corrected so that the body portion 4*c* of the inserted portion 4 provided in the first column 21 of the first pallet 11 is disposed substantially directly above the first column 21 of the second pallet 12, while the inner peripheral surface of the guide portion 4*b* of the first pallet 11 contacts the upper end portion of the first column 21 of the second pallet 12.

Here, when the relationship between the length L2 of the one side of the column 2 and the length L3 of the one side of the lower opening of the guide portion 4*b* is $L3\leq 1.2\times L2$, it is difficult to insert the upper end portion of the first column 21 of the second pallet 12 into the guide portion 4*b* of the inserted portion 4 provided in the first column 21 of the first pallet 11, and when the relationship thereof is $L3\geq 5\times L2$, the ability to correct the position of the first pallet 11 decreases.

Figure 4C:
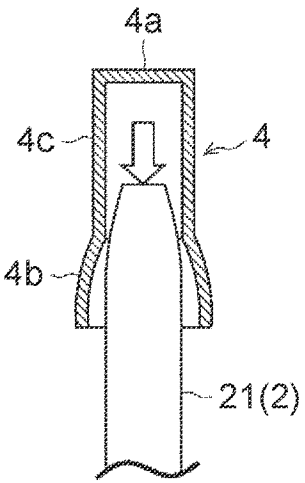
FIG. 4C is a diagram showing how the upper end portion of the column of the pallet disposed in the lower stage is inserted into the inserted portion of the pallet disposed in the upper stage.

Then, in a state where the body portion 4*c* of the inserted portion 4 provided in the first column 21 of the first pallet 11 is disposed substantially directly above the first column 21 of the second pallet 12, the first pallet 11 is further lowered. Thus, as shown in FIG. 4C, the upper end portion of the first column 21 of the second pallet 12 is inserted into the body portion 4*c* of the inserted portion 4 provided in the first column 21 of the first pallet 11.

Figure 5:
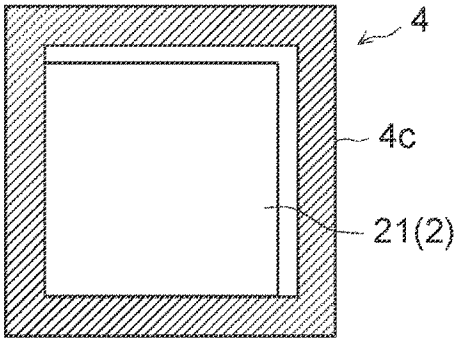
FIG. 5 is a diagram showing the relationship between a body portion of the inserted portion of the pallet disposed in the upper stage and the upper end portion of the column of the pallet disposed in the lower stage.

At this time, when the first column 21 of the second pallet 12 is a rectangular column, and the inner peripheral shape of the body portion 4*c* of the inserted portion 4 provided in the first column 21 of the first pallet 11 is a rectangular shape, the rotation angle and the position of the first pallet 11 are defined. FIG. 5 is a diagram showing the relationship between the body portion of the inserted portion provided in the first column of the first pallet and the upper end portion of the first column of the second pallet.

Specifically, in the case where the first column 21 of the second pallet 12 is a rectangular column and the inner peripheral shape of the body portion 4*c* of the inserted portion 4 provided in the first column 21 of the first pallet 11 is a rectangular shape, as shown in FIG. 5, when the upper end portion of the first column 21 of the second pallet 12 is inserted into the body portion 4*c* of the inserted portion 4 provided in the first column 21 of the first pallet 11, two adjacent sides of the body portion 4*c* of the inserted portion 4 of the first pallet 11 come into contact with two adjacent sides of the upper end portion of the first column 21 of the second pallet 12, thereby the rotation angle and the position of the first pallet 11 with respect to the second pallet 12 are defined.

That is, the front-rear direction and the right-left direction of the first pallet 11 with respect to the second pallet 12 are defined. As a result, even if the rotation angle and the position of the first pallet 11 with respect to the second pallet 12 are slightly deviated, the inserted portions 4 provided in the second columns 22 of the first pallet 11 can be accurately disposed substantially directly above the second columns 22 of the second pallet 12.

Here, when the height H1 is less than 1% of the diagonal length L1 of the pallet 1, the ability to define the rotation angle and the position of the first pallet 11 is poor. Considering the ability to define the rotation angle and the position of the first pallet 11, the height H1 does not have to be larger than 20% of the diagonal length L1 of the pallet 1.

Subsequently, in the state where the inserted portions 4 of the first pallet 11 are disposed substantially directly above the columns 2 of the second pallet 12, as shown in FIG. 3C, the first pallet 11 is further lowered. As a result, the upper end portions of the columns 2 of the second pallet 12 are inserted into the inserted portions 4 of the first pallet 11.

Here, in the case where the height H1 and the height of the guide portion 4*b* are set to heights where, when the upper end portion of the first column 21 of the first pallet 11 is inserted into the body portion 4*c* of the inserted portion 4 provided in the first column 21 of the second pallet 12 by about 10 mm or more, the upper end portions of the second columns 22 of the second pallet 12 are inserted into the guide portions 4*b* of the inserted portions 4 provided in the second columns 22 of the first pallet 11, the inserted portions 4 provided in the second columns 22 of the first pallet 11 can be accurately disposed substantially directly above the second columns 22 of the second pallet 12, and then the upper end portions of the columns 2 of the second pallet 12 can be inserted into the inserted portions 4 of the first pallet 11.

Figure 4D:
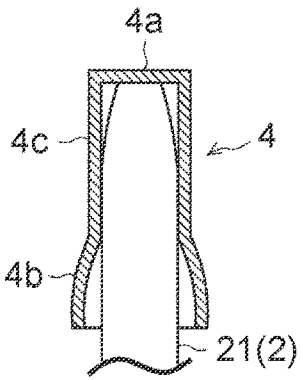
FIG. 4D is a diagram showing how the upper end portion of the column of the pallet disposed in the lower stage is inserted into the inserted portion of the pallet disposed in the upper stage.

Subsequently, the first pallet 11 is further lowered, and as shown in FIG. 4D, the upper end portion of the first column 21 of the second pallet 12 is brought into contact with the bottom portion 4*a* of the inserted portion 4 provided in the first column 21 of the first pallet 11. Similarly, the upper end portions of the second columns 22 of the second pallet 12 are brought into contact with the bottom portions 4*a* of the inserted portions 4 provided in the second columns 22 of the first pallet 11. As a result, the first pallet 11 is stacked on the upper side of the column 2 of the second pallet 12.

At this time, as described above, since the inserted portions 4 of the first pallet 11 are accurately disposed substantially directly above the columns 2 of the second pallet 12, only by lowering the first pallet 11, the upper end portions of the second columns 22 of the second pallet 12 can be easily inserted into the inserted portions 4 provided in the second columns 22 of the first pallet 11, and moreover, the first pallet 11 can be accurately stacked on the upper side of the second pallet 12.

Further, since the depth of the inserted portion 4 provided in the lower end portion of the first column 21 is deeper than the depth of the inserted portions 4 provided in the lower end portions of the second columns 22 by the height H1, the first pallet 11 can be stacked on the upper side of the second pallet 12 while suppressing the inclination of the first pallet 11 with respect to the second pallet 12.

As described above, the pallet 1 of the present embodiment has a simple configuration in which, of the columns 2, the height of at least one of the columns 2 is higher than the heights of the other columns 2. Therefore, when the pallet 1 of the present embodiment is used, the pallet 1 can be stacked with high accuracy while suppressing an increase in cost.

Here, when the outer peripheral shape of the upper end portion of the first column 21 and the inner peripheral shape of the body portion 4*c* of the inserted portion 4 provided in the first column 21 are not rectangular shapes as described above, for example, by rotating the first pallet 11 around the upper end portion of the first column 21 of the second pallet 12, the inserted portions 4 provided in the second columns 22 of the first pallet 11 can be easily disposed substantially directly above the second columns 22 of the second pallet 12.

Moreover, since the guide portions 4*b* are provided in the lower portions of the inserted portions 4, the body portions 4*c* of the inserted portions 4 of the first pallet 11 can be easily guided substantially directly above the columns 2 of the second pallet 12.

Further, when the outer peripheral shape of the upper end portion of the first column 21 and the inner peripheral shape of the body portion 4*c* of the inserted portion 4 provided in the first column 21 are rectangular shapes, by inserting the upper end portion of the first column 21 of the second pallet 12 into the body portion 4*c* of the inserted portion 4 provided in the first column 21 of the first pallet 11, the inserted portions 4 provided in the second columns 22 of the first pallet 11 can be accurately disposed substantially directly above the second columns 22 of the second pallet 12.

Therefore, the upper end portions of the second columns 22 of the second pallet 12 can be easily inserted into the inserted portions 4 provided in the second columns 22 of the first pallet 11, and moreover, the first pallet 11 can be accurately stacked on the upper side of the second pallet 12.

Second Embodiment

In the first embodiment, an operator operates the forklift 5 to stack the pallet 1, but the pallet 1 may be stacked using a self-propelled moving body. First, the configuration of a stacking system 31 for the pallet 1 according to the present embodiment will be described.

Figure 6:
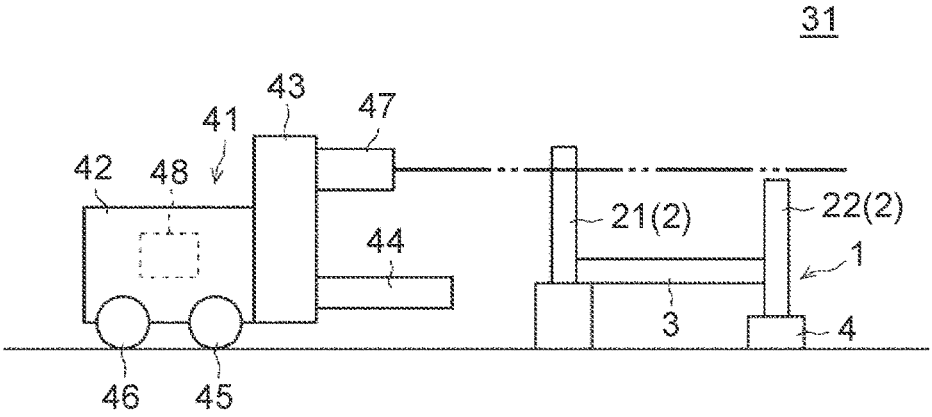
FIG. 6 is a side view showing how an upper end portion of a column is detected by a detection unit provided in a moving body in a pallet stacking system according to a second embodiment.
Figure 7:
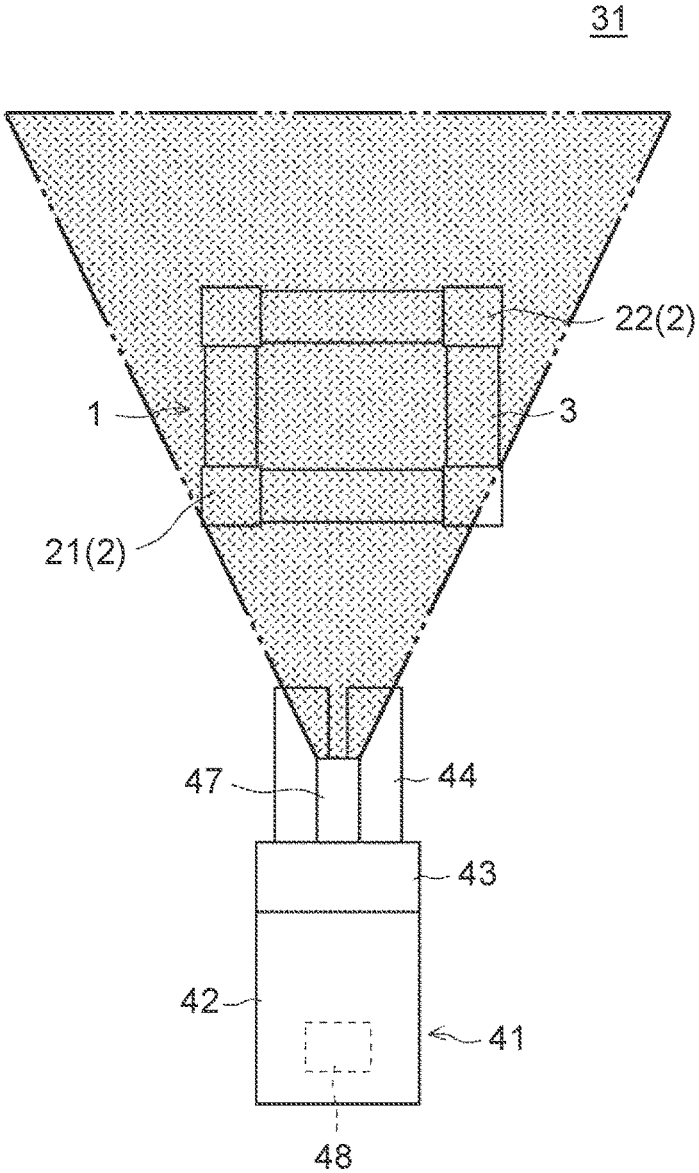
FIG. 7 is a plan view showing how the upper end portion of the column is detected by the detection unit provided in the moving body in the pallet stacking system according to the second embodiment.
Figure 8:
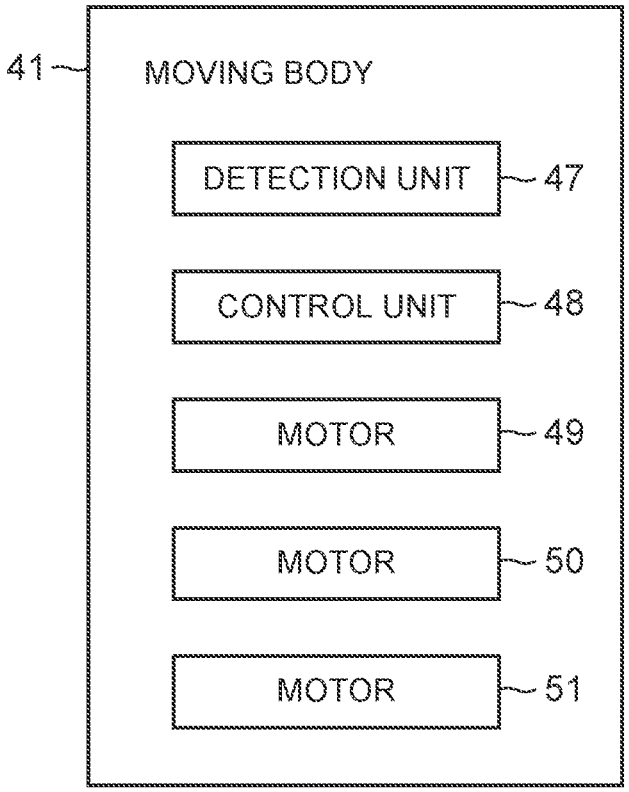
FIG. 8 is a block diagram showing a control system of the moving body in the pallet stacking system according to the second embodiment.

FIG. 6 is a side view showing how the upper end portion of the first column is detected by a detection unit provided in a moving body in a pallet stacking system according to the present embodiment. FIG. 7 is a plan view showing how the upper end portion of the first column is detected by the detection unit provided in the moving body in the pallet stacking system according to the present embodiment. FIG. 8 is a block diagram showing a control system of the moving body in the pallet stacking system according to the present embodiment. Note that in FIGS. 6 and 7, a laser beam emitted from the detection unit is shown by a long dashed double-short dashed line. Further, in FIG. 7, the hatched portion indicates the detection range of the detection unit.

In the present embodiment, as shown in FIGS. 6 and 7, the stacking system 31 is composed of the pallet 1 of the first embodiment and a moving body 41. The moving body 41 is a self-propelled forklift. Specifically, as shown in FIGS. 6 and 7, the moving body 41 includes a chassis 42, a mast 43 provided in front of the chassis 42, forks 44 that can be raised and lowered in the up-down direction along the mast 43, drive wheels 45 and steering wheels 46 provided in the chassis 42, a detection unit 47, and a control unit 48.

The detection unit 47 detects the first column 21 as the preset column 2 of the pallet 1. The detection unit 47 includes, for example, a laser range sensor and is fixed to the moving body 41 so as to detect the upper end portion of the first column 21 of the pallet 1 placed on the facility floor and so as not to detect the upper end portions of the second columns 22 as shown in FIGS. 6 to 8. The detection unit 47 is not limited to the laser range sensor, and may be a general photoelectric sensor.

Here, as shown in FIG. 7, the detection unit 47 of the present embodiment has a detection area so that all the columns 2 of the pallet 1 can be substantially covered within the detection area when the pallet 1 is viewed in the up-down direction. However, the detection unit 47 only needs to have a detection area that can cover at least one of the columns 2 of the pallet 1 within the detection area.

The control unit 48 controls a motor 49 for raising and lowering the forks 44 shown in FIG. 7, a motor 50 for driving the drive wheels 45, and a motor 51 for steering the steering wheels 46, while referring to the detection result of the detection unit 47 so that the moving body 41 moves along a preset path and stacks the pallets 1.

Further, the control unit 48 calculates, based on the detection result of the detection unit 47, coordinate of, for example, the position of the center of gravity in the front-rear direction and the right-left direction of the first column 21 with a preset position of the moving body 41 acting as the origin, and the rotation angle of the pallet 1 around the axis that passes through the position of the center of gravity of the first column 21 and extends in the up-down direction. As the position of the first column 21, the coordinate of the first column 21 and the rotation angle of the pallet 1 in the horizontal plane are preferably calculated. Further, the origin may be a point other than the center of gravity as long as it can be calculated from the position of the first column 21, and may be, for example, any one point of the four corners of the column.

Here, it is preferable that the control unit 48 is composed of a computer including a central processing unit (CPU), and the control unit 48 executes a program to realize the stacking process of the pallet 1 described later.

The above-mentioned program is stored using various types of non-transitory computer-readable media and can be supplied to a computer (a computer including an information notification device). The non-transitory computer-readable media include various types of tangible storage media. Examples of the non-transitory computer-readable media include magnetic recording media (e.g., flexible disks, magnetic tapes, hard disk drives) and magneto-optical recording media (e.g., magneto-optical disks). Further, the examples include a compact disc (CD)-read only memory (ROM), a CD-R, and a CD-R/W. Further, the examples include a semiconductor memory (e.g., mask ROM, PROM, EPROM, flash ROM, RAM). The program may be supplied to the computer by various types of transitory computer-readable media. Examples of the transitory computer-readable media include electrical signals, optical signals, and electromagnetic waves. The transitory computer-readable media can supply the program to the computer via a wired communication path such as an electric wire and an optical fiber, or a wireless communication path.

Next, the flow of stacking the pallet 1 using the stacking system 31 of the present embodiment will be described. First, the control unit 48 of the moving body 41 controls the motors 50 and 51 causes the moving body 41 to run on the facility floor so that the moving body 41 is disposed in front of the first pallet 11 placed on the facility floor.

Figure 9:
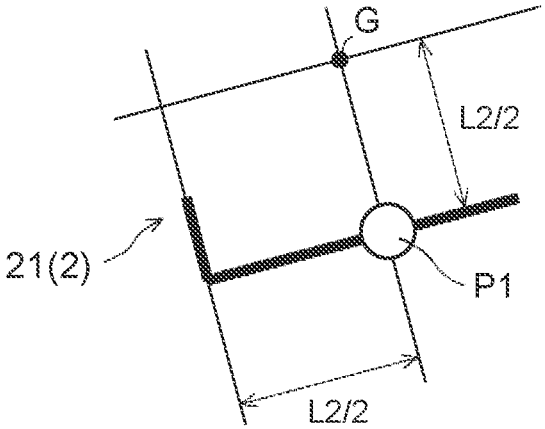
FIG. 9 is a diagram for illustrating the position of the center of gravity of the upper end portion of the column.

Next, the control unit 48 of the moving body 41 calculates the coordinate of the upper end portion of the first column 21 of the first pallet 11 and the rotation angle of the first pallet 11 based on the detection result of the detection unit 47. Here, as shown in FIG. 9, when the first column 21 is a rectangular column and the pallet 1 is rotated, there are cases where the adjacent corners of the first column 21 cannot be detected by the detection unit 47, and thus the coordinate of the upper end portion of the first column 21 may not be accurately calculated.

At this time, when the first column 21 is a rectangular column and the position at half the length L2 along one side of the first column 21 from the detected corner of the first column 21 is defined as a point P1, the position G of the center of gravity of the first column 21 is provided at a position at half the length L2 from the point P1 in the normal direction with respect to the one side.

Thus, the control unit 48 can calculate the coordinate of the first column 21 based on the coordinate of the corner detected in the first column 21, the length L2 of the one side of the preset first column 21, and the rotation angle of the first pallet 11.

In this way, even if the first pallet 11 is rotated and placed with respect to the moving body 41, the coordinate of the first column 21 can be accurately calculated. The rotation angle of the first pallet 11 can be calculated based on the inclination of the one side of the first column 21 with respect to the axis extending in the right-left direction.

Next, the control unit 48 of the moving body 41 controls the motors 49, 50, and 51 so that the moving body 41 approaches the first pallet 11 and raises the first pallet 11 with the forks 44. At this time, the moving body 41 stores the coordinate of the upper end portion of the first column 21 of the first pallet 11 and the rotation angle of the first pallet 11 immediately before raising the first pallet 11. Then, in the state where the first pallet 11 is raised, the control unit 48 controls the motors 50 and 51 so that the moving body 41 is disposed in front of the second pallet 12 that is placed on the facility floor in advance.

Next, the control unit 48 of the moving body 41 calculates the coordinate of the upper end portion of the first column 21 of the second pallet 12 and the rotation angle of the second pallet 12 based on the detection result of the detection unit 47. Then, the control unit 48 compares the coordinate of the first column 21 of the first pallet 11 and the rotation angle of the first pallet 11 with the coordinate of the first column 21 of the second pallet 12 and the rotation angle of the second pallet 12, and controls the motors 50 and 51 so as to substantially match each other. As a result, the inserted portions 4 of the first pallet 11 are disposed substantially directly above the columns 2 of the second pallet 12.

Subsequently, the control unit 48 of the moving body 41 controls the motor 49 to lower the first pallet 11 with the forks 44 of the moving body 41 so that the upper end portion of the first column 21 of the second pallet 12 is inserted into the inserted portion 4 provided in the first column 21 of the first pallet 11.

Thus, the upper end portion of the first column 21 of the second pallet 12 is inserted into the inserted portion 4 provided in the first column 21 of the first pallet 11, and as described in the first embodiment, the first pallet 11 is accurately disposed on the upper side of the second pallet 12.

Subsequently, the control unit 48 of the moving body 41 controls the motor 49 to lower the first pallet 11 with the forks 44 of the moving body 41. Thus, the upper end portions of the second columns 22 of the second pallet 12 are inserted into the inserted portions 4 provided in the second columns 22 of the first pallet 11, and the first pallet 11 is stacked on the upper side of the second pallet 12.

As described above, also in the present embodiment, since the pallet 1 having a simple configuration in which the height of at least one of the columns 2 is higher than the heights of the other columns 2 is used, the pallet 1 can be stacked with high accuracy while suppressing an increase in cost. Moreover, it is not necessary to provide a plurality of detection units to calculate the coordinate of the support column 2 and the rotation angle of the pallet 1, and therefore the pallet 1 can be stacked with high accuracy while suppressing an increase in cost.

Here, the moving body 41 is preferably provided with a detection unit for detecting that the pallet 1 is placed on the forks 44. In this way, the control unit 48 can accurately recognize that the first pallet 11 is stacked on the second pallet 12.

Third Embodiment

FIGS. 10A to 10D are diagrams showing how the pallet according to the present embodiment is stacked. FIGS. 11A to 11D are diagrams showing how the upper end portion of the column of the second pallet is inserted into the inserted portion of the first pallet.

Figure 10A:
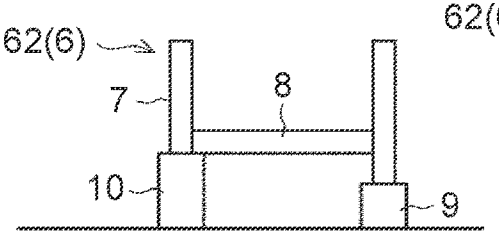
FIG. 10A is a diagram showing how a pallet according to a third embodiment is stacked.
Figure 10B:
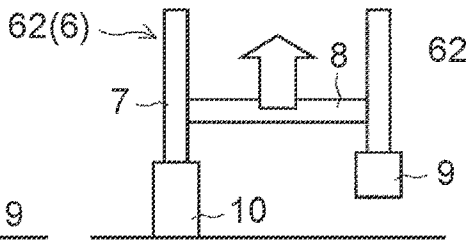
FIG. 10B is a diagram showing how a pallet according to a third embodiment is stacked.
Figure 10C:
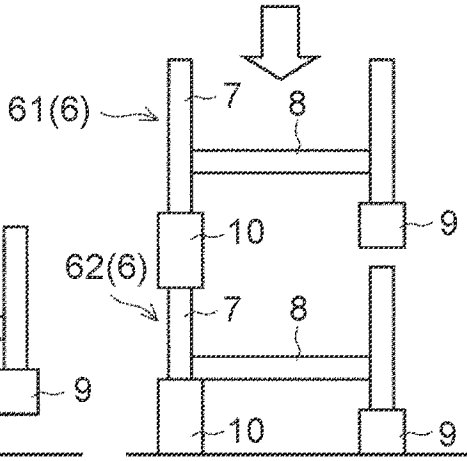
FIG. 10C is a diagram showing how a pallet according to a third embodiment is stacked.
Figure 10D:
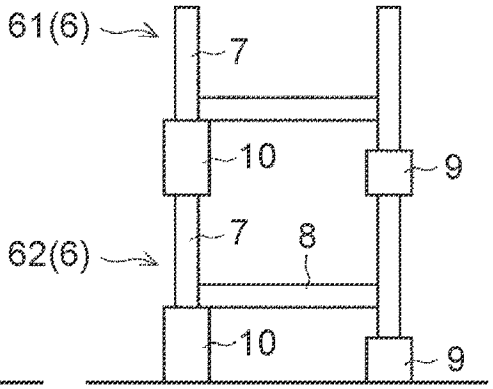
FIG. 10D is a diagram showing how a pallet according to a third embodiment is stacked.

A pallet 6 in the present embodiment also has a configuration in which, as shown in FIG. 10D and the like, the upper end portions of columns 7 of the pallet disposed in the lower stage (hereinafter may be referred to as a second pallet 62) are inserted into inserted portions 9 provided in the lower end portions of the columns 7 of the pallet disposed in the upper stage (hereinafter may be referred to as a first pallet 61), such that the pallet 6 can be stacked in the up-down direction.

Specifically, as shown in FIG. 10A and the like, the pallet 6 includes the columns 7, beams 8, the inserted portions 9, and a cup 10, and for example, the pallet 6 is assembled into a rectangular frame structure when viewed in the up-down direction. However, the shape of the pallet 6 when viewed in the up-down direction is not limited to the rectangular shape, and may be a circular shape, an elliptical shape, or a polygonal shape.

Figure 11A:
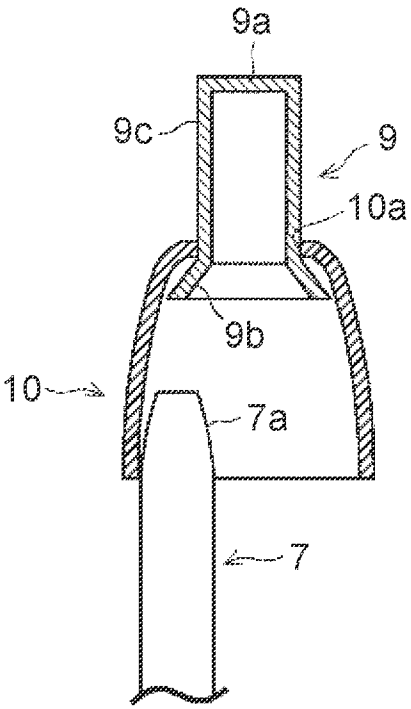
FIG. 11A is a diagram showing how the upper end portion of the column of the pallet disposed in the lower stage is inserted into the inserted portion of the pallet disposed in the upper stage.

The columns 7 extend in the up-down direction and are disposed so that the upper end portions of the columns 7 are substantially positioned at the same height. For example, all the columns 7 are columns having substantially the same length. Further, as shown in FIG. 11A and the like, the upper end portion of the column 7 is preferably provided with a tapered portion 7*a* that narrows toward the upper side of the column 7. The columns 7 preferably have a hollow structure for weight reduction.

The beams 8 connect the lower portions of the adjacent columns 7. In this case, to be able to insert the forks of the forklift between the beams 8 and the facility floor, the height between the lower end portions of the beams 8 and the lower end portions of the pallet 6 is set higher than the height of the forks of the forklift.

The inserted portion 9 is provided at the lower end portion of each of the columns 7, and when the first pallet 61 is stacked on the upper side of the second pallet 62, the upper end portions of the columns 7 of the second pallet 62 are inserted into the inserted portions 9 of the first pallet 61.

As shown in FIG. 11A and the like, the inserted portion 9 has a tubular shape having a bottom portion 9*a* at the upper end portion of the inserted portion 9, and the inner peripheral shape of the inserted portion 9 corresponds to the outer peripheral shape of the upper end portion of the column 7. For example, the inner peripheral shape of the inserted portion 9 is preferably slightly larger than the outer peripheral shape of the upper end portion of the column 7. The depths of the inserted portions 9 are substantially the same.

Here, as shown in FIG. 11A and the like, it is preferable that a guide portion 9*b* is provided in the lower portion of the inserted portion 9. The guide portion 9*b* guides a body portion 9*c* provided above the guide portion 9*b* in the inserted portion 9 of the first pallet 61 to the upper end portion of the column 7 of the second pallet 62.

The inner peripheral shape of the guide portion 9*b* is an inverted bowl-shape that narrows toward the upper side of the guide portion 9*b*, and the upper end portion of the inner peripheral surface of the guide portion 9*b* is substantially continuous with the lower end portion of the inner peripheral surface of the body portion 9*c* of the inserted portion 9. That is, the inserted portion 9 of the present embodiment includes the guide portion 9*b* having an inverted bowl-shaped inner peripheral surface, and the body portion 9*c* provided above the guide portion 9*b* and having an inner peripheral surface corresponding to the outer peripheral surface of the upper end portion of the column 7.

The cup 10 is provided in at least one of the columns 7 so as to be slidable in the up-down direction with respect to the column 7. The cup 10 has an inverted bowl-shape having an opening 10*a* at the upper end of the cup 10, and the body portion 9*c* of the inserted portion 9 passes through the inside of the opening 10*a*.

As shown in FIG. 10A, when the pallet 6 is placed on the facility floor, the cup 10 slides upward along the body portion 9*c* of the inserted portion 9, so that the lower end portion of the inserted portion 9 and the lower end portion of the cup 10 are disposed at substantially the same height.

As shown in FIG. 10B, when the pallet 6 is raised, the cup 10 slides to the lower side along the body portion 9*c* of the inserted portion 9, and in the state where the peripheral edge of the opening 10*a* of the cup 10 is hooked on the guide portion 9*b* of the inserted portion 9, the lower portion of the cup 10 protrudes from the lower end portion of the inserted portion 9. At this time, the cup 10 covers the inserted portion 9. Here, the inner peripheral surface of the cup 10 and the lower end portion of the guide portion 9*b* of the inserted portion 9 are preferably disposed so as to be substantially continuous.

Next, the flow of stacking the pallet 6 using the pallet 6 of the present embodiment will be described. Here, in the present embodiment, it is assumed that an operator operates the forklift to stack the pallet 6.

First, from the state where the first pallet 61 is placed on the facility floor as shown in FIG. 10A, the forks of the forklift are inserted between the beam 8 of the first pallet 61 and the floor, and the first pallet 61 is raised by the forklift as shown in FIG. 10B.

Thus, the cup 10 slides to the lower side along the body portion 9*c* of the inserted portion 9, and in the state where the peripheral edge of the opening 10*a* of the cup 10 is hooked on the guide portion 9*b* of the inserted portion 9, the lower portion of the cup 10 protrudes from the lower end portion of the inserted portion 9.

Then, the forklift places the first pallet 61 on the upper side of the second pallet 62. At this time, the first pallet 61 is placed on the second pallet 62 so that the columns 7 of the second pallet 62 are disposed substantially directly below the columns 7 of the first pallet 61.

Next, as shown in FIG. 10C, the forklift lowers the first pallet 61 and inserts the upper end portion of the column 7 of the second pallet 62 into the cup 10 through which the inserted portion 9 of the first pallet 61 passes.

Specifically, as shown in FIG. 11A, the first pallet 61 is lowered so that the upper end portion of the column 7 of the second pallet 62 is inserted into the cup 10 through which the inserted portion 9 of the first pallet 61 passes.

Figure 11B:
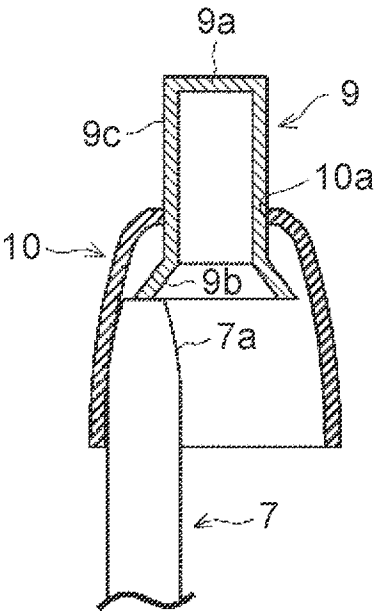
FIG. 11B is a diagram showing how the upper end portion of the column of the pallet disposed in the lower stage is inserted into the inserted portion of the pallet disposed in the upper stage.

Then, as shown in FIG. 11B, the forklift further lowers the first pallet 61. In this way, the position of the first pallet 61 with respect to the second pallet 62 is corrected so that the guide portion 9*b* of the inserted portion 9 of the first pallet 61 is disposed substantially directly above the column 7 of the second pallet 62, while the inner peripheral surface of the cup 10 through which the inserted portion 9 of the first pallet 61 passes contacts the upper end portion of the column 7 of the second pallet 62.

Then, the position of the first pallet 61 is adjusted using the forklift so that, in the state where the guide portion 9*b* provided in the inserted portion 9 of the first pallet 61 is disposed substantially directly above the column 7 of the second pallet 62, the guide portions 9*b* of the remaining inserted portions 9 of the first pallet 61 are disposed substantially directly above the columns 7 of the second pallet 62.

At this time, when the first pallet 61 is rotated around the upper end portion of the column 7 of the second pallet 62 that is inserted into the cup 10 of the first pallet 61, the position of the first pallet 61 can be adjusted with relatively high accuracy.

The first pallet 61 is further lowered to insert the columns 7 of the second pallet 62 into the guide portions 9*b* of the inserted portions 9 of the first pallet 61. At this time, the guide portion 9*b* of the first pallet 61 has an inverted bowl-shape.

Therefore, the position of the first pallet 61 with respect to the second pallet 62 is corrected so that the body portion 9*c* of the inserted portion 9 of the first pallet 61 is disposed substantially directly above the column 7 of the second pallet 62, while the inner peripheral surface of the guide portion 9*b* of the first pallet 61 contacts the upper end portion of the column 7 of the second pallet 62. Here, when the inner peripheral surface of the cup 10 and the lower end portion of the guide portion 9*b* of the inserted portion 9 are disposed so as to be substantially continuous, the position of the first pallet 61 can be smoothly corrected.

Figure 11C:
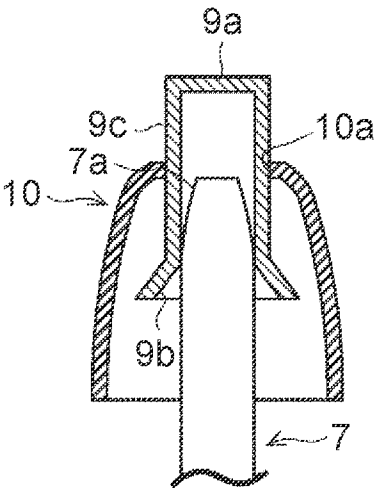
FIG. 11C is a diagram showing how the upper end portion of the column of the pallet disposed in the lower stage is inserted into the inserted portion of the pallet disposed in the upper stage.

Next, in the state where the body portions 9*c* of the inserted portions 9 of the first pallet 61 are disposed substantially directly above the columns 7 of the second pallet 62, the first pallet 61 is further lowered, and as shown in FIG. 11C, the upper end portion of the column 7 of the second pallet 12 is inserted into the body portion 9*c* of the inserted portion 9 of the first pallet 61.

In this case, although not shown, when a part of the cup 10 protrudes from the inserted portion 9, as shown in FIG. 11C and the like, the cup 10 can slide upward as the column 7 of the second pallet 12 is inserted into the body portion 9*c* of the inserted portion 9 of the first pallet 61.

Figure 11D:
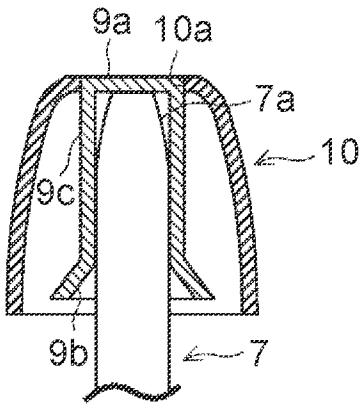
FIG. 11D is a diagram showing how the upper end portion of the column of the pallet disposed in the lower stage is inserted into the inserted portion of the pallet disposed in the upper stage.

Subsequently, as shown in FIG. 10D and FIG. 11D, the first pallet 61 is further lowered, and the upper end portions of the columns 7 of the second pallet 62 are brought into contact with the bottom portions 9*a* of the inserted portions 9 of the first pallet 61. As a result, the first pallet 61 is stacked on the upper side of the column 7 of the second pallet 62.

As described above, the pallet 6 of the present embodiment has a simple configuration in which, of the columns 7, at least one of the columns 7 is provided with the slidable cup 10. Therefore, when the pallet 6 of the present embodiment is used, the pallet 6 can be stacked with high accuracy while suppressing an increase in cost.

In the present embodiment, an operator operates the forklift to stack the pallet 6, but the pallet 6 may be stacked using a self-propelled moving body as in the second embodiment. At this time, the detection unit of the moving body preferably detects, for example, the position of the column 7 on the right front side of the pallet 6 as a preset column 7 of the pallet 6 placed on the facility floor, and then the moving body preferably executes the flow of stacking the pallet 6 of the third embodiment. The detection unit only needs to detect the position of at least one of the columns 7.

The present disclosure is not limited to the above embodiments, and can be appropriately modified without departing from the spirit thereof.

For example, in the case where the columns 2 of the first and second embodiments are configured to have cylindrical shapes, when the heights of at least two columns 2 are configured to be higher than the heights of the other columns 2, the position of the first pallet 11 with respect to the second pallet 12 can be corrected when stacking the first pallet 11 on the upper side of the second pallet 12.

Further, in the case where the columns 2 of the first and second embodiments are configured to have elliptical shapes, as in the first and second embodiments, when the height of at least one column 2 is configured to be higher than the heights of the other columns 2, the position of the first pallet 11 with respect to the second pallet 12 can be corrected when stacking the first pallet 11 on the upper side of the second pallet 12.

For example, in the first and second embodiments, the configuration is such that the difference between the depth of the inserted portion 4 provided in the first column 21 and the depths of the inserted portions 4 provided in the second columns 22 in the pallet 1 is substantially equal to the difference H1 between the height of the first column 21 and the heights of the second columns 22. However, it is only necessary that the first pallet 11 can be stacked on the upper side of the second pallet 12 while suppressing the inclination of the first pallet 11, and the configuration may be such that a stopper or the like is provided inside the inserted portion 4 provided in the first column 21 so that the upper end portion of the first column 21 of the second pallet 12 is not inserted beyond a preset depth.

What is claimed is:

1. A pallet that is stackable in an up-down direction in which upper end portions of a plurality of columns of a pallet disposed in a lower stage are inserted into inserted portions provided in lower end portions of columns of a pallet disposed in an upper stage so that the pallet disposed in the upper stage has a same orientation as the pallet disposed in the lower stage, wherein a height of at least one column of the plurality of columns is higher than heights of other columns among the plurality of columns.

2. The pallet according to claim 1, the pallet comprising a guide portion in a lower portion of each of the inserted portions, wherein when the pallet disposed in the upper stage is stacked on the pallet disposed in the lower stage, the guide portion of the inserted portion of the pallet disposed in the upper stage guides a body portion provided above the guide portion of the inserted portion of the pallet disposed in the upper stage to the upper end portion of the at least one column of the pallet disposed in the lower stage.

3. The pallet according to claim 1, wherein a depth of the inserted portion of the at least one column having the height higher than the heights of the other columns is deeper than depths of the inserted portions of the other columns.

4. The pallet according to claim 3, wherein a difference between the depth of the inserted portion of the at least one column having the height higher than the heights of the other columns and the depths of the inserted portions of the other columns is equal to a difference between the height of the at least one column having the height higher than the heights of the other columns and the heights of the other columns.

5. The pallet according to claim 1, wherein:

the at least one column has a polygonal shape or a shape having a rotation stopper; and an inner peripheral shape of at least a part of the inserted portion is larger than an outer peripheral shape of the at least one column, and has a polygonal shape corresponding to the outer peripheral shape of the at least one column or a shape having a rotation stopper.

6. A pallet stacking system comprising:

the pallet according to claim 1;

a self-propelled moving body to raise and lower the pallet; and a detection unit provided in the self-propelled moving body to detect the at least one column as a preset column in the pallet.

7. A pallet that is stackable in an up-down direction in which upper end portions of a plurality of columns of a pallet disposed in a lower stage are inserted into inserted portions provided in lower end portions of columns of a pallet disposed in an upper stage, the pallet comprising a cup that is provided in at least one column of the columns so as to be slidable in a height direction of the at least one column, wherein a lower end portion of the cup protrudes from a lower end portion of the inserted portion so as to be lower than the lower end portion of the inserted portion when the pallet disposed in the upper stage is raised, and wherein the cup slides upward along the inserted portion so that the lower end portion of the inserted portion and the lower end portion of the cup are disposed at substantially the same height when the pallet disposed in the upper stage is stacked on the pallet disposed in the lower stage.

8. The pallet according to claim 7, further comprising a guide portion in a lower portion of each of the inserted portions, wherein:

when the pallet disposed in the upper stage is stacked on the pallet disposed in the lower stage, the guide portion of the inserted portion of the pallet disposed in the upper stage guides a body portion provided above the guide portion of the inserted portion of the pallet disposed in the upper stage to the upper end portion of the column of the pallet disposed in the lower stage; and the cup covers the lower end portion of the guide portion when the pallet disposed in the upper stage is raised.

9. A pallet stacking method being a method for stacking a pallet in which upper end portions of a plurality of columns of a pallet disposed in a lower stage are inserted into inserted portions provided in lower end portions of columns of a pallet disposed in an upper stage, the pallet stacking method comprising:

disposing the pallet disposed in the upper stage on an upper side of the pallet disposed in the lower stage in which a height of at least one column of the plurality of columns is higher than heights of other columns among the plurality of columns;

lowering the pallet disposed in the upper stage and inserting an upper end portion of the at least one column having the height higher than the heights of the other columns of the pallet disposed in the lower stage into an inserted portion of the pallet disposed in the upper stage; and further lowering the pallet disposed in the upper stage and inserting upper end portions of the other columns of the pallet disposed in the lower stage into the inserted portions of the pallet disposed in the upper stage so that the pallet disposed in the upper stage has a same orientation as the pallet disposed in the lower stage.

10. A pallet stacking method being a method for stacking a pallet in which upper end portions of a plurality of columns of a pallet disposed in a lower stage are inserted into inserted portions provided in lower end portions of columns of a pallet disposed in an upper stage, the pallet stacking method comprising:

raising the pallet disposed in the upper stage and having a cup that is provided in at least one column of the columns to be slidable in a height direction of the at least one column to protrude from a lower end portion of the inserted portion so as to be lower than the lower end portion of the inserted portion;

lowering the pallet disposed in the upper stage and inserting the upper end portion of the column of the pallet disposed in the lower stage into the cup of the pallet disposed in the upper stage;

rotating the pallet disposed in the upper stage around the upper end portion of the column of the pallet disposed in the lower stage, the upper end portion being inserted into the cup of the pallet disposed in the upper stage, to align the upper end portion of the column of the pallet disposed in the lower stage with the inserted portion of the pallet disposed in the upper stage; and further lowering the pallet disposed in the upper stage and inserting the upper end portion of the column of the pallet disposed in the lower stage into the inserted portion of the pallet disposed in the upper stage, wherein a lower end portion of the inserted portion and a lower end portion of the cup are disposed at substantially the same height when the pallet disposed in the upper stage is stacked on the pallet disposed in the lower stage.

* * * * *